US007717723B2

(12) United States Patent
Nehm

(10) Patent No.: US 7,717,723 B2
(45) Date of Patent: May 18, 2010

(54) ELECTRICAL PLUG-IN CONNECTOR AND INTERLOCKING CLIP FOR INTERLOCKING OF TWO HOUSING PARTS

(75) Inventor: Detlef Nehm, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 12/424,099

(22) Filed: Apr. 15, 2009

(65) Prior Publication Data

US 2009/0258530 A1 Oct. 15, 2009

(30) Foreign Application Priority Data

Apr. 15, 2008 (DE) ..... 10 2008 019 016

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 3,101,230 A * 8/1963 Bausch et al. ..... 439/357
4,911,647 A * 3/1990 Ferchau et al. ..... 439/157
5,658,162 A 8/1997 Harting et al.
6,106,337 A * 8/2000 Yu et al. ..... 439/637
7,258,556 B1 * 8/2007 Boutros et al. ..... 439/142

FOREIGN PATENT DOCUMENTS

DE 42 27 078 A1 2/1994
DE 10 2004 061 046 A1 7/2006
EP 1 345 291 A1 9/2003
EP 1 691 454 A2 8/2006

* cited by examiner

*Primary Examiner*—Hien Vu
(74) *Attorney, Agent, or Firm*—David S. Safran; Roberts Mlotkowski Safran & Cole, P.C.

(57) ABSTRACT

An electrical plug-in connector with a first housing part, a second housing part and at least one metal interlocking clip which is pivotally mounted on the first housing part, two bearing journals being mounted on the first housing part and two interlocking projections being provided on the second housing part, the interlocking clip having two interlocking legs and a handle piece which connects the interlocking legs to one another, the interlocking legs each having a bearing arm with a recess for the bearing journal and an interlocking arm for overlapping an interlocking projection. Damage to the interlocking projections by the metal interlocking arms is prevented by two plastic parts which are located on the two interlocking legs of an interlocking clip such that a respective section of a plastic part covers the free end surface of an interlocking arm when the interlocking clip is pivoted into the closed position.

15 Claims, 5 Drawing Sheets

ELECTRICAL PLUG-IN CONNECTOR AND INTERLOCKING CLIP FOR INTERLOCKING OF TWO HOUSING PARTS

BACKGROUND OF THE INVENTION

1. Field of Invention

The invention relates to an electrical plug-in connector with a first housing part, a second housing part and at least one metal interlocking clip which is pivotally mounted on one of the two housing parts, two bearing journals being provided on the first housing part and two interlocking projections being made on the second housing part, the interlocking clip having two interlocking legs and a handle piece which connects the interlocking legs to one another and the interlocking legs each having a bearing arm with a recess for the bearing journal and an interlocking arm for overlapping an interlocking projection. In addition, the invention also relates to an interlocking clip for interlocking of two housing parts, especially two housing parts of an electrical plug-in connector, with two interlocking legs and a handle piece which connects the interlocking legs to one another.

2. Description of Related Art

Electrical plug-in connectors of the above mentioned type have been used for many years, especially in industry, and therefore, are often also called industrial plug-in connectors. The plug-in connectors generally have a housing base and a built-on housing as the first housing part and a housing cover or sleeve housing as the second housing part. Within the two housing parts there are generally several terminals which are electrically connected to one another to form a terminal strip, the terminal strips having plug-in contacts or jacks so that when the top part of the housing is slipped onto the bottom part of the housing, the terminals of the top part of the housing are electrically conductively connected to the corresponding terminals of the bottom part of the housing.

Since these industrial plug-in connectors are often used under extremely harsh conditions, the plug-in connectors must meet high tightness requirements, for which the two housing parts must be reliably interlocked with one another even when exposed to strong vibrations and high mechanical load. For this purpose, there must be at least one interlocking clip (often two interlocking clips) pivotally mounted on one of the two housing parts, and in the interlocked position, overlaps two interlocking projections or interlocking pins which are located on the other housing part, by which the two housing parts are held together with one another.

For example, European Patent Application EP 1 691 454 A2 discloses the initially described electrical plug-in connector. In this plug-in connector, the interlocking clip is punched out of a metal sheet in one piece and is bent such that it is made roughly U-shaped. The U-back or base leg of the interlocking clip here forms a handle piece, while the two U-legs are made as interlocking legs or interlocking clamps. The interlocking legs each have a bearing arm with a bearing recess for the articulated pins located on the first housing part and an interlocking arm for overlapping the interlocking pins which are located on the second housing part.

A similar plug-in connector is also disclosed by German Patent Application DE 10 2004 061 046 B4. In this plug-in connector, the interlocking clip is punched out of a metal sheet in one piece and bent. In this interlocking clip, the interlocking arm which overlaps the catch projection in the closed position is made rigid while the bearing arm is made as a spring leg. Because the known interlocking clips are punched out of a metal sheet and bent, production of the interlocking clip is relatively simple, and thus, is also associated only with low costs. However, here, the disadvantage is that punch edges are formed by punching out the interlocking clip and the interlocking projections on the second housing part can be damaged during interlocking as a result.

If the interlocking projections are made of plastic or of a relatively soft material, for example aluminum, when the interlocking clip is pivoted into the closed position, surface wear occurs on the interlocking projection; this can ultimately lead to the interlocking projections being parted. Even if the interlocking projections are made of a harder metal, when the interlocking clip is pivoted into the closed position friction occurs between the two metal parts, specifically between the interlocking projection and the interlocking arm, by which the surface of the two metals parts is involved so that corrosion can form more quickly.

SUMMARY OF THE INVENTION

Therefore, a primary object of this invention is to provide an electrical plug-in connector and an interlocking clip of the initially described type for two housing parts, especially for two housing parts of an electrical plug-in connector, in which the aforementioned disadvantages are avoided. At the same time it is to be ensured that reliable and permanent interlocking of the two housing parts is guaranteed by means of the interlocking clip.

The above object is achieved in an electrical plug-in connector of the initially described type in that there are two plastic parts and they are arranged on the two interlocking clips such that a section of a respective plastic part covers at least the free end surface of an interlocking arm which rubs over the interlocking projection when the interlocking clip is pivoted into the closed position. The arrangement of the plastic parts in accordance with the invention thus prevents the metallic interlocking clips from rubbing over the interlocking projections when the interlocking clip is pivoted into the closed position, since there is a section of a plastic part between the free end surface of one interlocking arm assigned to the respective interlocking projection and the assigned interlocking projection which thus slides over the interlocking projection when the interlocking clip is pivoted into the closed position.

According to one advantageous configuration, a depression made on the interlocking arm in the completely closed position of the interlocking clip overlaps the interlocking projection so that, on the one hand, the interlocking clip is locked in the closed position, and on the other hand, the force for interlocking the two housing parts is accommodated by the metal interlocking clip, especially the interlocking legs. Here, the section of the plastic part is dimensioned such that it does not cover the depression in the interlocking arm. When the interlocking clip is pivoted into the closed position the section of the plastic part thus forms a slide bearing with the interlocking projection which is made on the second housing part, while in the completely closed position of the interlocking clip the interlocking arm with its depression overlaps the interlocking projection.

Fundamentally, there are various possibilities for how the plastic part can be attached to the interlocking arm. For example, the plastic part could be cemented to the end of the interlocking arm or the interlocking arm in the corresponding region of the plastic part could be coated. According to one preferred embodiment of the invention, the two plastic parts assigned to the two interlocking legs are, however, each made as separate plastic injection molded parts. The two plastic parts are attached to the two interlocking legs, according to one embodiment of the invention, by there being on two interlocking legs spaced laterally relative to the interlocking arm, another arm being connected by way of a connecting bridge to the free end of the interlocking arm such that the plastic part with an attachment region is located between the interlocking arm and the other arm. The plastic part can be clamped with its attachment region between the interlocking arm and the other arm which is spaced laterally to it.

According to a preferred configuration of the invention, the two plastic parts which are each assigned to an interlocking leg are made such that they have two legs each and a back which connects the legs being formed on the first leg the section which covers the free end surface of the interlocking arm and a second leg corresponding to the recess in the bearing arm having a recess for a bearing journal. This execution of the plastic part, first of all, has the advantage that the plastic part, in the mounted state, is held additionally in its position by the bearing journal which is made on the first housing part extending not only through the recess in the bearing arm of the interlocking leg, but also through the corresponding recess in the second leg of the plastic part. When the interlocking clip is pivoted out of the opened position into the closed position the plastic part is thus also pivoted around the bearing journal.

A plastic part made in this way can, moreover, be additionally used to prevent unintentional, independent pivoting of the interlocking clip. For this purpose, between the recess in the second leg of the plastic part and the bearing journal on the first housing part, a force fit is formed which provides for the interlocking clip to be able to be pivoted only by applying a certain force. The force fit between the recess in the second leg of the plastic part and the bearing journal can be chosen such that, on the one hand, the interlocking clip can be pivoted by hand without a major expenditure of force, but on the other hand, remains in its respective position without intentional activation.

In the same manner as the plastic part according to the first embodiment has not only a section which covers the free end surface of the interlocking arm and an attachment region, but is made essentially U-shaped, preferably also there is not only another arm spaced laterally relative to the interlocking arm, but also an essentially U-shaped clip element. According to this preferred configuration, the interlocking clip has two U-shaped clip elements which are each spaced laterally to the two interlocking legs, and whose first leg is joined to the free end of the interlocking arm by way of a connecting bridge and is bent such that it is located spaced laterally relative to the interlocking arm. The second leg of the clip element is located spaced laterally relative to the bearing arm and has a recess which corresponds to the recess in the bearing arm for the bearing journal. The two legs of the clip element are connected to one another by way of a rigid connecting section which forms the U-back of the U-shaped clip element.

A clip element which is made in this way and which is connected in one piece to the interlocking arm and is bent by roughly 180° so that the first leg is aligned essentially parallel to the free end of the interlocking arm and the second leg is aligned essentially parallel to the bearing arm can be used not only to hold the plastic part, but at the same time, also can be used to provide overstretch protection for the interlocking leg. For this purpose, the recess in the second leg of the clip element is made as a slot. When the interlocking leg widens as it is slid onto the interlocking projection due to its slightly elastic property, the first leg of the clip element is also moved or entrained due to its connection to the interlocking arm, this motion being limited by the dimensions of the slot which is made in the second leg and through which the bearing journal extends.

If the two housing parts, which are held together by way of the interlocking clip, are pulled apart by external forces, the expansion of the interlocking legs is limited by the maximally possible path of motion of the bearing journal in the slot of the second leg of the clip element. Expansion of the interlocking legs beyond this is prevented by the rigid clip element so that the interlocking leg is prevented from being overstretched when great forces are acting on the two housing parts. The forces which act on the interlock between the two housing parts are then accommodated by the rigid clip element. Since, as a result of the formation of the slot in the second leg of the clip element, the rigid clip element enables a certain, allowable expansion of the interlocking legs, at the same time, the pivoting of the interlocking clip into the closed position is facilitated since the interlocking arm can be pivoted more easily onto the interlocking projection due to the limited elastic property of the interlocking leg.

The aforementioned object in an interlocking clip for interlocking of two housing parts, with two interlocking legs and a handle piece which connects the interlocking legs to one another, is achieved in that there are two plastic parts and they are arranged on the interlocking legs such that a respective section of the plastic part covers at least the free end surface of the interlocking arm which faces the respective bearing arm and which rubs over a second interlocking projection on the second housing part when the interlocking clip is pivoted into the closed position. With respect to the advantages of an interlocking clip which is made in this way and which can be used especially for interlocking of the two housing parts of an electrical plug-in connector, reference is made to the above in conjunction with the electrical plug-in connector in accordance with the invention.

According to one advantageous configuration of the interlocking clip in accordance with the invention, the two interlocking arms of the two interlocking legs each have a depression for holding one interlocking projection made on the housing part at a time in the closed position of the interlocking clip, the section of the plastic part which covers the free end surface of the interlocking arm being dimensioned such that it does not cover the depression. As described beforehand in conjunction with the electrical plug-in connector, this results in that the depression of a metallic interlocking arm overlaps the two interlocking projections in the closed position of the interlocking clip.

According to another advantageous configuration of the interlocking clip in accordance with the invention, which will be only briefly mentioned here, an actuating opening is formed in the handle piece into which a tool, especially the tip of a screwdriver, can be inserted. In this way, the actuation of the interlocking clip can be facilitated when the interlocking clip or the handle piece is only poorly accessible due to restricted space conditions or due to the attachment position of the electrical plug-in connector. Moreover, a greater force for opening or closing the interlocking clip can be applied by a screwdriver which has been inserted into the actuating opening.

If the two interlocking legs and the handle piece are integrally connected to one another, the interlocking clip can be produced especially easily as punched and bent part. The one-piece execution of the interlocking clip also increases its mechanical stability so that with simultaneously simple production a durable interlocking clip which thus ensures reliable interlocking can be made available.

In particular, there are a host of possibilities for embodying and developing the electrical plug-in connector and the interlocking clip in accordance with the invention.

DETAILED DESCRIPTION OF THE INVENTION

Figure 1:
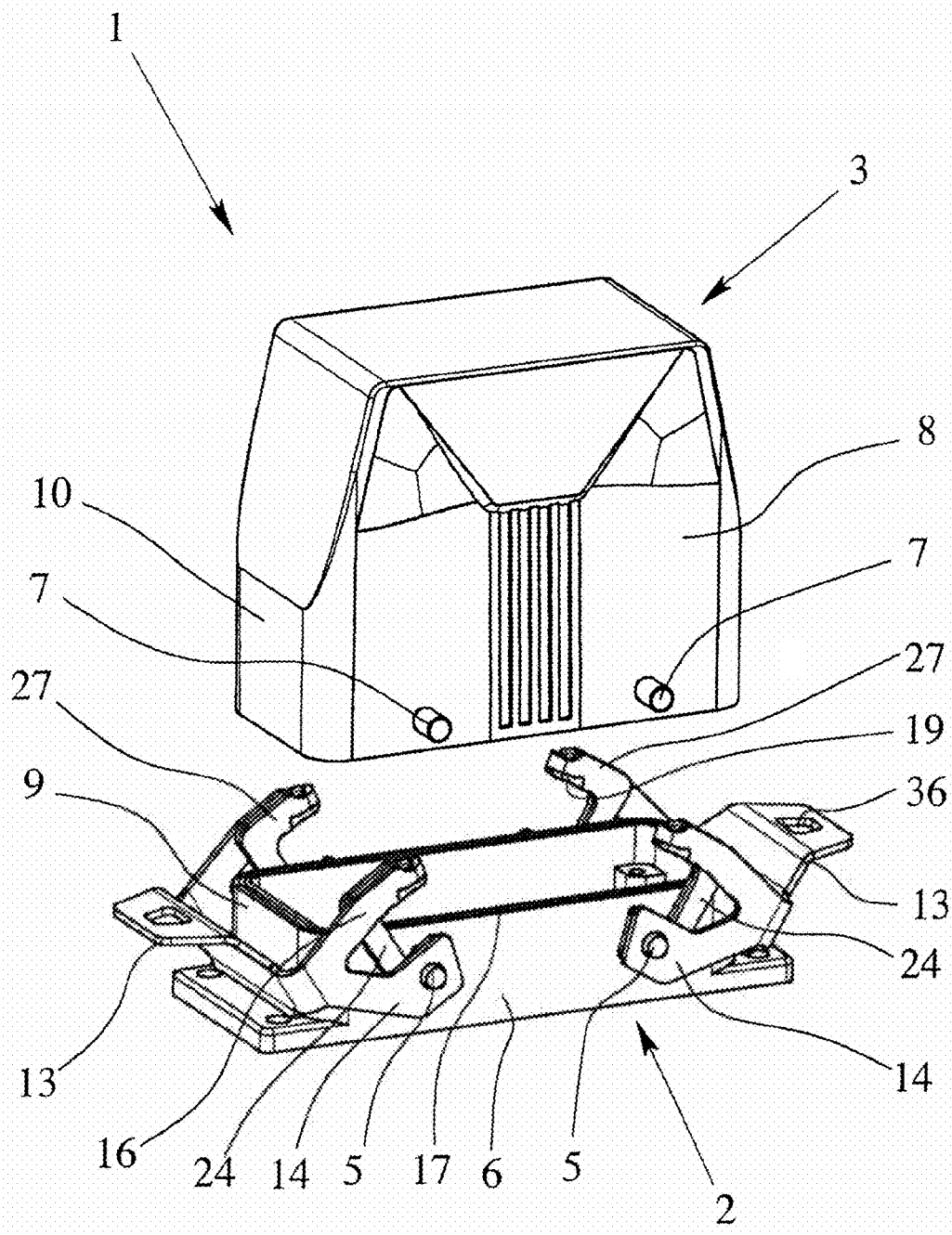
FIG. 1 is an exploded perspective view of an electrical plug-in connector, with a first housing part and a second housing part in a disconnected state.
Figure 2:
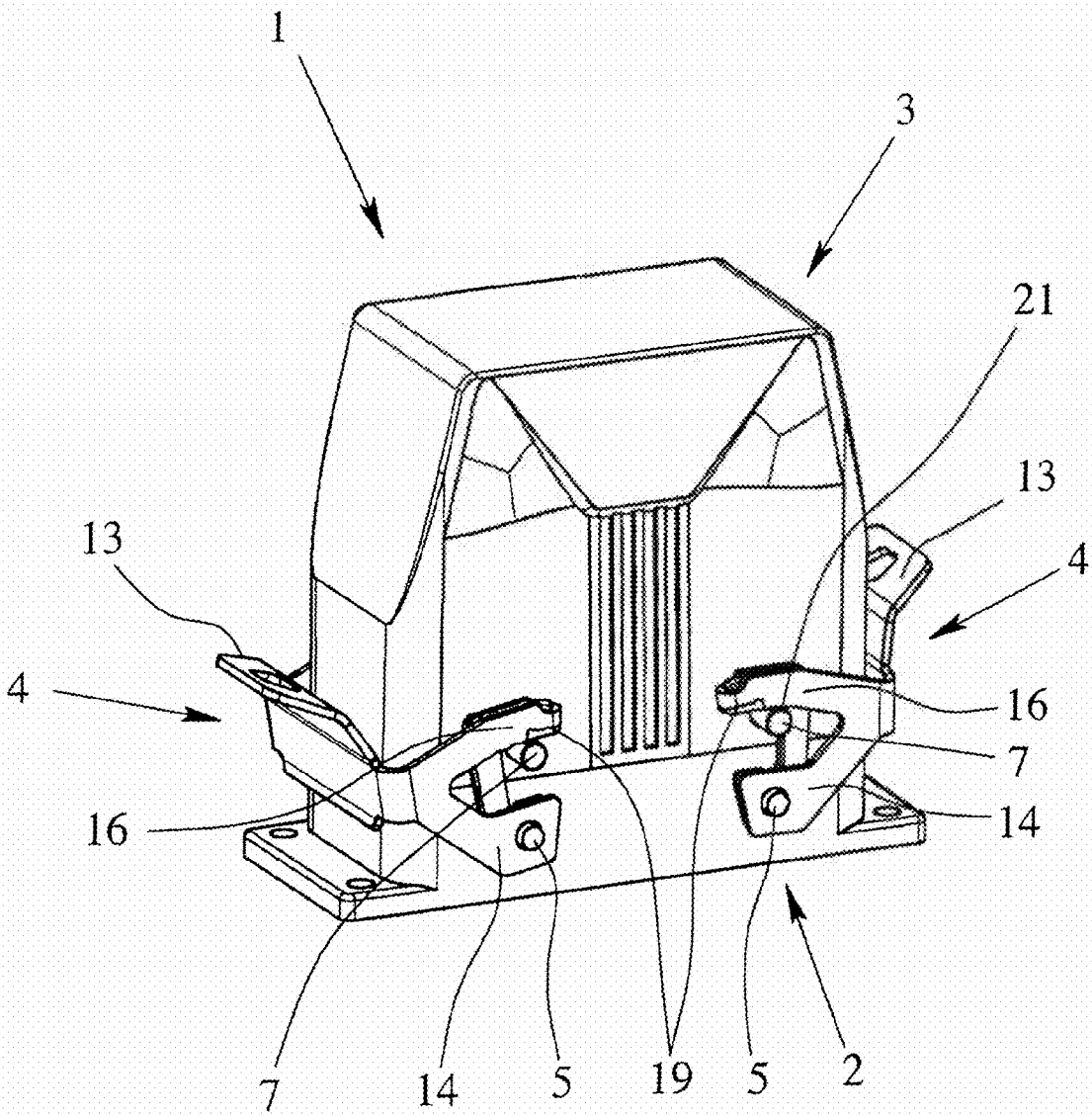
FIG. 2 shows the electrical plug-in connector of FIG. 1 in the locked state.

FIGS. 1 & 2 show an electrical plug-in connector 1 which has a housing base as the first housing part 2 and a housing cover as the second housing part 3. Within the two housing parts 2, 3, there can be several terminals which are connected to one another to form a terminal strip or contact insert for connection of the individual leads of an electrical cable which are, however, not shown in the figures since this invention relates to interlocking of the two housing parts 2, 3.

For attachment or interlocking of the two housing parts 2, 3, to one another, in the illustrated embodiment, there are two identical interlocking clips 4 which are pivotally attached to the first housing part 2. To support the interlocking clips 4, there are two bearing journals 5 for each clip 4 so that, in the illustrated embodiment, the first housing part 2 has a total of four bearing journals 5 which are arranged in pairs opposite one another on the two lengthwise sides 6 of the first housing part 2.

To interlock the second housing part 3, i.e., the top part of the housing, to the first housing part 2, on the second housing part 3 four interlocking projections 7 made as interlocking pins are formed. The interlocking pins 7 are arranged in pairs opposite one another on the two lengthwise sides 8 of the second housing part 3, and the interlocking pins 7 can be made either in one piece with the second housing part 3 or attached, especially can be riveted, as separate interlocking pins 7 to the second housing part 3. Preferably, both of the housing parts 2, 3 and also the bearing journals 5 and the interlocking projections 7 are made of metal.

Instead of the attachments of the two interlocking clips 4 to the housing base 2 as shown in FIGS. 1 & 2, the interlocking clips 4 can also be pivotally mounted on the housing cover 3, then the bearing journals 5 would be located on the housing cover 3, and accordingly, the interlocking projections 7 would be located on the housing base 2. Moreover, the interlocking clips 4, which are made as transverse clips in the figures, can also be made as lengthwise clips so that then the bearing journals 5 and the interlocking projections 7 are located not on the lengthwise sides 6, 8 of the housing base 2 or the housing cover 3, but on their transverse sides 9, 10. Finally, for interlocking of the two housing parts 2, 3, for certain electrical plug-in connectors 1, the use of only one interlocking clip 4 can also be sufficient. If the electrical plug-in connector 1 has only one interlocking clip 4, the bearing journals 5 are generally located in the middle of the lengthwise sides 6 or the transverse sides 9 of the housing base 2 or in the middle of the lengthwise sides 8 or the transverse sides 10 of the housing cover 3.

Figure 3:
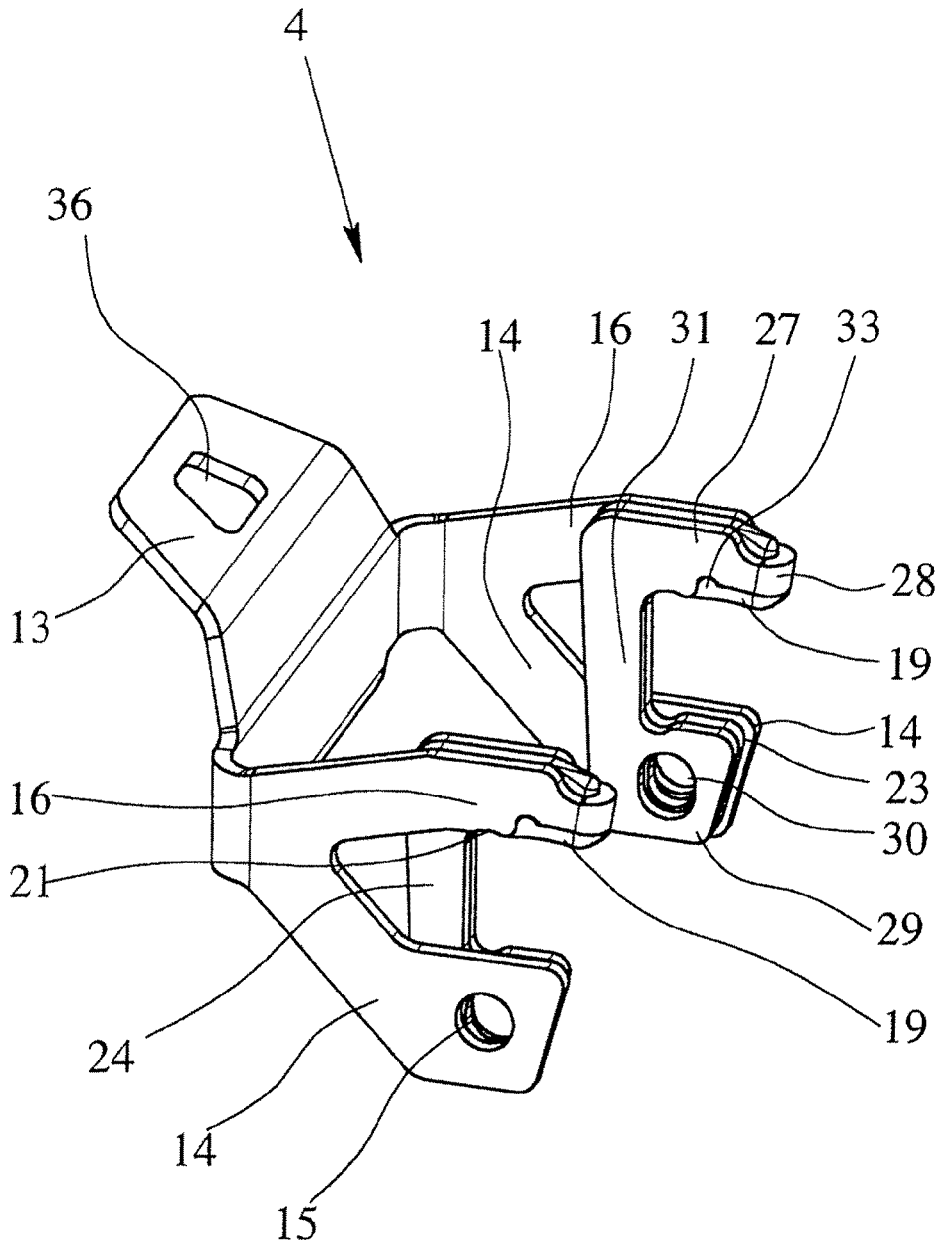
FIG. 3 is a perspective of an interlocking clip in accordance with the invention.

The interlocking clip 4, shown separately in FIG. 3, has two opposite interlocking legs 11, 12 and a handle piece 13 which connects the interlocking legs 11, 12 to one another, the two interlocking legs 11, 12 each having a bearing arm 14 with a recess 15 for a bearing journal 5 and an interlocking arm 16 for overlapping the interlocking projection 7 in the closed position of the interlocking clip 4. The two roughly V-shaped interlocking legs 11, 12 are each made flexible such that the interlocking legs 11, 12 can slightly spread apart when the interlocking clip 4 is pivoted out of the opened position shown in FIG. 1 into the closed position shown in FIG. 2. In the closed position of the interlocking clip 4, the two interlocking arms 16 overlap the corresponding interlocking projections 7 on the top part 3 of the housing, by which the two housing parts 2, 3 are tightly joined to one another. To ensure sufficient tightness of the plug-in connector 1, there is a rubber seal 17 in the groove in the first housing part 2 which seals the two housing parts 2, 3 relative to one another in the state interlocked to one another.

Figure 4:
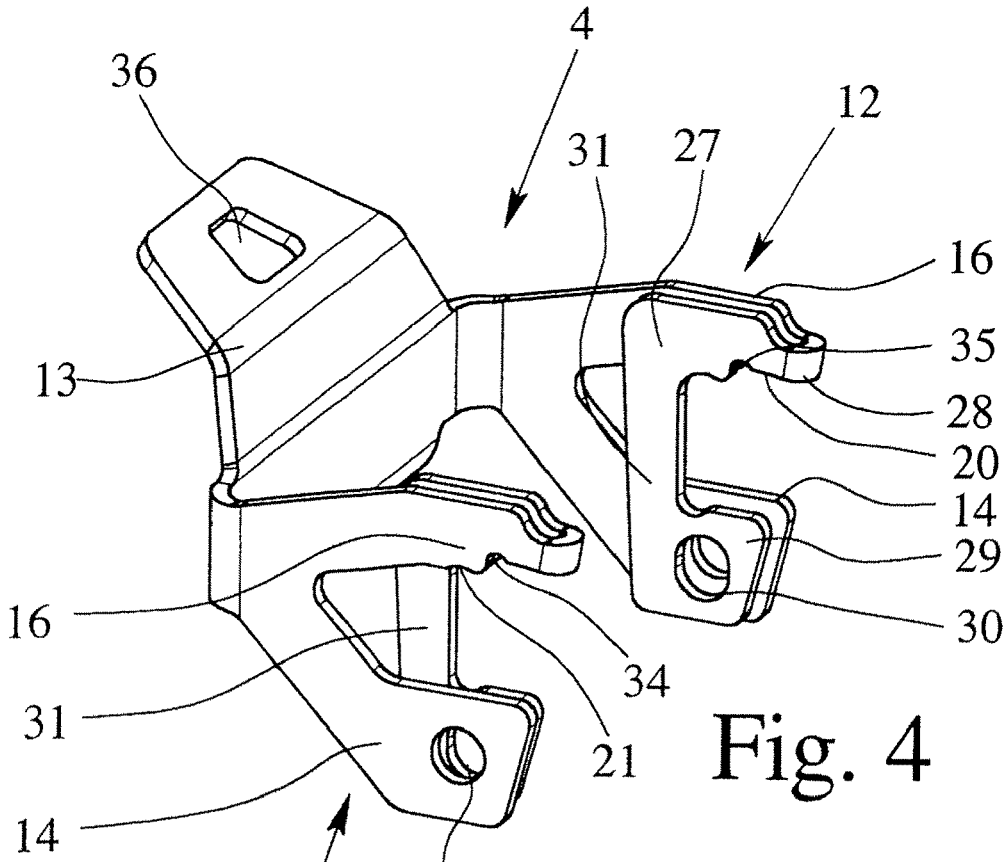
FIG. 4 shows the interlocking clip of FIG. 3 without the plastic parts.
Figure 5:
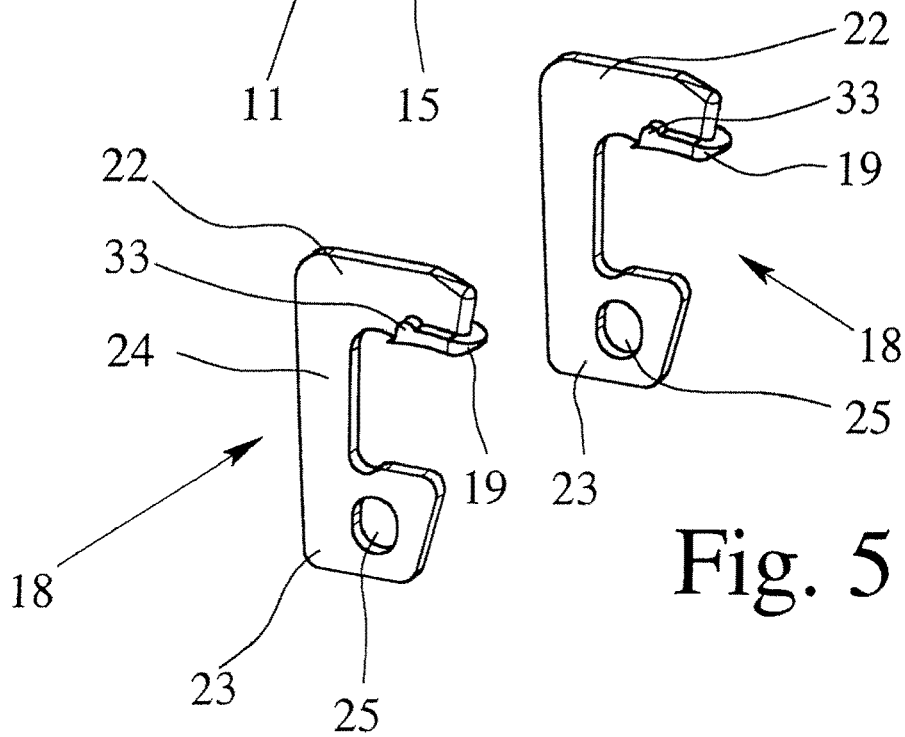
FIG. 5 is a separate perspective representation of the two plastic parts of the interlocking shown in FIG. 3.

As is especially apparent from FIG. 3 as well as FIGS. 4 & 5, on the two interlocking legs 11, 12 of the interlocking clip 4, there are two plastic parts 18 which each have a section 19 which slides over the interlocking projections 7 when the interlocking clip 4 pivots into the closed position. The section 19 is made or arranged such that it covers the free end surface 20 of the interlocking arm 16 which would rub over an interlocking projection 7 when the interlocking clip 4 is pivoted into the closed position. This prevents the surface of the interlocking projection 7 from wearing off when the interlocking clip 4 is pivoted into the closed position; this ultimately could lead to the interlocking projection 7 being damaged or even parted. This danger prevails especially even when the interlocking projections 7 is made of a softer metal than the interlocking clip 4, for example, of aluminum or of plastic, and when the interlocking clip 4 is made as a punched and bent part and thus has rough or sharp punched edges.

The arrangement of the plastic parts 18 in the interlocking legs 11, 12 prevents damage to the interlocking projections 7 since, when the interlocking clip 4 is pivoted into the closed position, the respective section 19 of the two plastic parts 18 slides over the interlocking projections 7. In the representation of the plug-in connector 1 in FIG. 2, the left-hand interlocking clip 4 is in the not yet entirely closed position in which the section 19 of the plastic part 18 slides over the interlocking projection 7. In contrast, the right-hand interlocking clip 4 is in the completely closed position in which the depression 21 which is formed on the interlocking arm 16 overlaps the interlocking projection 7. This leads, on the one hand, to the interlocking clip 4 locking in the completely closed position, and on the other hand, the force for interlocking of the two housing parts 2, 3 being applied by the metal interlocking clip 4, especially the two interlocking legs 11, 12. The section 19 of the plastic part 18 is dimensioned such that it does not cover the depression 21.

It is apparent from FIG. 5 that the two plastic parts 18 are each made roughly U-shaped, specifically, having two legs 22, 23 and a back 24 which connects the legs 22, 23. On the first leg 22, a section 19 is made which covers the free end surface 20 of the interlocking arm 16. In the second leg 23, corresponding to the recess 15 in the bearing arm 14, there is a recess 25 for a bearing journal 5 so that, when the interlocking clip 4 is pivoted out of the opened into the closed position, the two plastic parts 18 are also pivoted around the bearing journals 5. The recess 25 is made as a slot so that the plastic part 18 has a certain dynamic play relative to the bearing journal in the vertical direction. The transverse extension of the recess 25 is somewhat smaller than the diameter of the bearing journal so that a force fit is formed between the recess 25 and the bearing journal 5. The force fit between the recess 25 in the plastic part 18 and the bearing journal 5 is chosen such that the interlocking clip 4, on the one hand, can be pivoted by hand, without a great expenditure of force, and on the other hand, however, it remains in its respective position without intentional actuation. Unintentional pivoting or "folding up" of the interlocking clip 4 can thus be prevented.

Fixing of the plastic parts 18 relative to the interlocking legs 11, 12 takes place, besides via the bearing journal 5, especially by two clip elements 26 being formed on the interlocking clip 4 and each of which is spaced laterally relative to a respective one of the interlocking legs 11, 12. The first leg 27 of the U-shaped clip element 26 is connected to the free end of the interlocking arm 16 by way of a connecting bridge 28, the clip element 26 being bent by roughly 180° such that the first leg 27 is located parallel to the interlocking arm 16 and the second leg 29 of the clip element 26 is located parallel to the bearing arm 14. The clip element 26 is arranged spaced apart from the interlocking leg 11, 12 such that the plastic parts 18 are held in the intermediate space between the clip elements 26 and the respective interlocking leg 11, 12.

The execution of the clip elements 26 on the interlocking clip 4 is thus used, first of all, to accommodate and hold the two plastic parts 18. Moreover, the clip elements 26 also act as overstretch protection for the two interlocking legs 11, 12. For this purpose, there is a recess, in the form of a slot 30, in the second leg 29 of the clip element 26, the slot 30 receiving a bearing journal 5. Moreover, the connecting section 31 which connects the two legs 27, 29 of the clip element 26 to one another is made so rigidly that the clip element 26 is prevented from expanding.

If the interlocking clip 4 is pivoted out of the opened position into the closed position, when the interlocking arm 16 slides onto the interlocking projection 7, the interlocking leg 11, 12 widens slightly. The interlocking arm 16 is deflected somewhat up in the arrangement of the interlocking clip 4 which is shown in FIG. 2. Since the first leg 27 of the clip element 26 is connected to the interlocking arm 16 by way of the connecting bridge 28, the first leg 27 is also moved up, the clip element 26 also moving altogether up as a result of the slot 30 which is formed in the second leg 29. Since the clip element 26 is rigid, the motion of the first leg 27 up is limited by the dimensions of the slot 30. If the lower edge of the slot 30 strikes the lower edge of the bearing journal 5, further motion of the clip element 26 up is blocked. At the same time further widening of the interlocking leg 11 is also prevented.

If the two housing parts 2, 3 which have been locked to one another by way of the interlocking clip or clips 4 are pulled apart from one another by external forces, widening of the interlocking legs 11, 12 is limited by the maximum possible path of motion of the bearing journal 5 in the slots 30 of the clip elements 26. Expansion of the interlocking legs 11, 12 which goes beyond this is prevented by the rigid clip elements 26 so that the clip elements 26 act as overstretch protection for the interlocking legs 11, 12.

The plastic part 18, which with the exception of the section 19, has essentially the same external dimensions as the clip element 26, with the first leg 22 as the first attachment region is located between the interlocking arm 16 and the first leg 27, and with the second leg 23 as the second attachment region located between the bearing arm 14 and the second leg 29. The section 19 of the plastic part 18 is dimensioned such that it covers both the end surface 20 of the interlocking arm 16 as well as the corresponding surface 32 of the first leg 27 of the clip element 26. The section 19 thus has a width which corresponds roughly to the sum of the width of the interlocking arm 16, the width of the first leg 27 and the distance between the interlocking arm 16 and the first leg 27.

Moreover, a bead-like projection 33 is formed on the section 19 of the plastic part 18 which engages a corresponding recess 34 in the interlocking arm 16 and a recess 35 in the first leg 27 of the clip element 26 so that the two plastic parts 18 are connected positively to the interlocking legs 11 and 12 and the clip elements 26 at least in the region of the sections 19.

To be able to easily actuate the interlocking clips 4 even when they are accessible by hand only with difficulty as a result of the limited space conditions or as a result of a special installation position of the electrical plug-in connector 1, in the handle piece 13 an actuating opening 36 is made for an actuating tool, especially the shaft of a screwdriver. By inserting the tip of a screwdriver through the actuating opening 36, a larger force can be applied for opening or closing the interlocking clip 4 due to the lever arm having been lengthened in this way.

Figure 6:
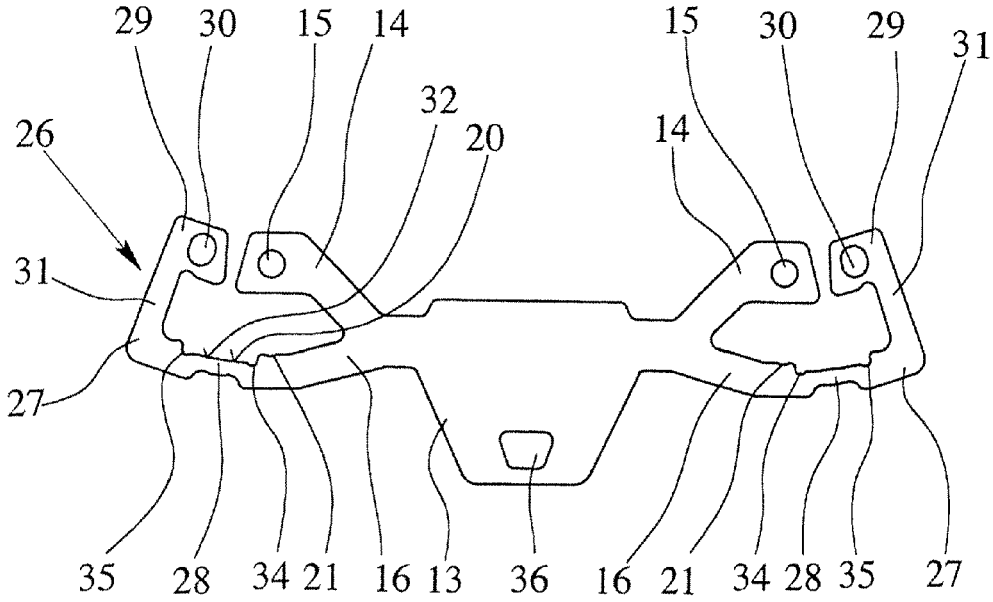
FIG. 6 shows a part which has been punched out of spring steel and from which an interlocking clip as shown in FIG. 3 can be produced.

FIG. 6 shows that the interlocking clip 4 in accordance with the invention can be made as a punched and bent part, specifically can be simply punched out of a metal part, especially out of spring steel, and then bent into its shape shown in FIG. 4. Moreover, it is apparent from FIG. 6 that the interlocking clip 4 is made entirely in one piece, especially also the clip elements 26 are connected in one piece with one interlocking arm 16 of a respective interlocking leg 11, 12 by way of the connecting bridge 28.

What is claimed is:

1. An electrical plug-in connector, comprising: a first housing part, a second housing part and at least one metal interlocking clip which is pivotally mounted on one of the first and second housing parts, wherein two bearing journals are provided on the first housing part and two interlocking projections are provided on the second housing part, wherein the interlocking clip has two interlocking legs and a handle piece which connects the interlocking to one another, wherein the interlocking legs each have a bearing arm with a recess for receiving the bearing journal and an interlocking arm which overlies the interlocking projection in a locking position of the interlocking clip for securing the first and second housing parts together, and wherein a plastic part is arranged on each of the two interlocking legs such that a section of each plastic part covers at least a free end surface of a respective interlocking arm, the plastic part rubbing over the interlocking projection when the interlocking clip is pivoted into the locking position;

wherein a second arm is spaced laterally parallel to each interlocking arm and is connected to a free end of the interlocking arm by a connecting bridge such that an attachment region of the section of the plastic part is located at the connecting bridge and between the interlocking arm and the second arm.

2. The electrical plug-in connector in accordance with claim 1, wherein the interlocking arm has a depression for holding the interlocking projection in the locking position of the interlocking clip and said section of the plastic part is dimensioned such that the depression is not covered.

3. The electrical plug-in connector in accordance with claim 1, wherein the plastic part has two legs and a back which connects the legs, the section which covers the free end surface of the interlocking arm being provided on the first leg and wherein a recess for a bearing journal is formed in the second leg at a location corresponding to the recess in the bearing arm.

4. The electrical plug-in connector in accordance with claim 3, wherein the recess in the second leg and the bearing journal on the first housing part are configured to produce a force fit connection in said locking position.

5. The electrical plug-in connector in accordance with claim 1, wherein the interlocking clip is U-shaped and has two clip elements spaced laterally relative to a respective interlocking leg, a first leg of the U-shaped clip element being connected to the free end of the interlocking arm by a connecting bridge and being arranged spaced laterally relative to the interlocking arm, a second leg of the U-shaped clip element being located spaced laterally relative to the bearing arm and having a recess which corresponds to the recess in the bearing arm for the bearing journal and is made as a slot, and wherein the two legs are connected to one another by a rigid connecting section.

6. The electrical plug-in connector in accordance with claim 1, wherein the section of the plastic part covers both the free end surface the interlocking arm and a corresponding surface of the second arm.

7. The electrical plug-in connector in accordance with claim 1, wherein the plastic part is connected positively to the interlocking legs.

8. The electrical plug-in connector in accordance with claim 1, wherein the interlocking projections on the second housing part are made of plastic or aluminum.

9. An interlocking clip for interlocking of two housing parts of an electrical plug-in connector, comprising two interlocking legs and a handle piece which connects the interlocking legs to one another, wherein the interlocking legs each have a bearing arm with a recess for receiving a bearing journal and an interlocking arm for overlying an interlocking projection in a locking position of the interlocking clip for securing first and second housing parts together, and wherein a plastic part is arranged on each of the two interlocking legs such that a section of each plastic part covers at least a free end surface of a respective interlocking arm, the plastic part being adapted to rub over the interlocking projection when the interlocking clip is in the locking position;

wherein a second arm is spaced laterally parallel to each interlocking arm and is connected to a free end of the interlocking arm by a connecting bridge such that an attachment region of the section of the plastic part is located at the connecting bridge and between the interlocking arm and the second arm.

10. The interlocking clip in accordance with claim 9, wherein the interlocking arm has a depression for holding the interlocking projection in the closed position of the interlocking clip, and the section of the plastic part is dimensioned such that the depression is not covered by the plastic part.

11. The interlocking clip in accordance with claim 9, wherein the plastic part has two legs and a back which connects the legs, the section of the plastic part being located on a first leg of the two legs at a location corresponding to the recess in the bearing arm and wherein a recess for a bearing journal is provided in a second of the two legs.

12. The interlocking clip in accordance with claim 11, wherein the interlocking clip is U-shaped and has two clip elements spaced laterally relative to a respective interlocking leg, a first leg of the U-shaped clip element being connected to the free end of the interlocking arm by a connecting bridge and being arranged spaced laterally relative to the interlocking arm, a second leg of the U-shaped clip element being located spaced laterally relative to the bearing arm and having a recess which corresponds to the recess in the bearing arm for the bearing journal and is made as a slot, wherein the two legs are connected to one another by a rigid connecting section and wherein the plastic part has an attachment region located between the interlocking arm and the first leg and a second attachment region between the bearing arm and the second leg.

13. The interlocking clip in accordance with claim 12, wherein the section of the plastic part covers both the free end surface of the interlocking arm and a corresponding surface of the first leg.

14. The interlocking clip in accordance with claim 13, wherein the section of the plastic part has a width which corresponds essentially to the sum of the width of the interlocking arm, the width of the first leg and the distance between the interlocking arm and the first leg.

15. The interlocking clip in accordance with one of claims 14, wherein the plastic part is connected positively to the interlocking leg.

* * * * *